US005655769A

United States Patent [19]

Arcari

[11] Patent Number: 5,655,769

[45] Date of Patent: Aug. 12, 1997

[54] ARM WRESTLING APPARATUS

[76] Inventor: Mario A. Arcari, 3710 Pitzer, Johnsburg, Ill. 60050

[21] Appl. No.: 417,519

[22] Filed: Apr. 5, 1995

[51] Int. Cl.[6] ..... A63B 21/28; A63F 7/02

[52] U.S. Cl. ..... 273/110; 273/452; 482/905

[58] Field of Search ..... 273/453, 110, 273/452; 482/905, 906; 73/379.08, 379.01; 194/231

[56] References Cited

U.S. PATENT DOCUMENTS

| | | | |
|---|---|---|---|
| 2,846,226 | 8/1958 | Reynolds | 273/110 |
| 3,333,851 | 8/1967 | Rosen | 273/110 |
| 3,539,188 | 11/1970 | Salverda | 273/110 |
| 3,934,881 | 1/1976 | Gordfarb et al. | 273/110 |
| 4,343,465 | 8/1982 | Allen | 482/905 X |
| 4,463,949 | 8/1984 | McCoy, Sr. et al. | 273/1 G |
| 4,564,191 | 1/1986 | Atkin | 73/379.08 X |
| 4,846,468 | 7/1989 | McCoy, Sr. et al. | 273/1 G |
| 5,078,031 | 1/1992 | Hoff | 482/905 X |

FOREIGN PATENT DOCUMENTS

| | | | |
|---|---|---|---|
| 0149562A2 | 7/1985 | European Pat. Off. . | |
| 2406463 | 6/1979 | France | 273/110 |
| 444713 | 5/1927 | Germany | 273/110 |
| 2200542 | 7/1973 | Germany . | |
| 142556 | 5/1920 | United Kingdom . | |
| 2152826 | 8/1985 | United Kingdom | 482/905 |

OTHER PUBLICATIONS

Popular Mechanics, Jan. 1963, pp. 162–163.

PCT International Search Report dated Jul. 29, 1996.

*Primary Examiner*—Paul E. Shapiro

*Attorney, Agent, or Firm*—Wallenstein & Wagner, Ltd.

[57] ABSTRACT

An improved arm wrestling apparatus for competitively matching the physical strength of two or more players as between the players. The apparatus includes first and second arm rods for transferring the forces exerted by one or more players along to the other players. The first and second arm rods are rotatably connected to each other through first and second couplers and a connector bar to prevent the arm bars from rotating beyond a predetermined angle. A set of arm bars are fixedly connected to the ends of the first and second arm rods for accepting and exerting the forces exerted and accepted by the players. The arm wrestling machine also includes a locking assembly for halting and releasing the connector bar. The locking assembly includes a support for the locking pin, a spring for biasing the locking pin in one direction, a lever for transferring force to the locking pin, and a controller for exerting or removing forces on the lever. The arm wrestling apparatus also includes a game portion. The game portion includes a generally planar surface pivotally disposed about a pivot point. The generally planar surface is coupled to the arm bar handles through a coupling means, the coupling means transferring forces, exerted on the handles, to the planar surface, the transferred forces causing the planar surface to pivot about the pivot point.

47 Claims, 7 Drawing Sheets

ARM WRESTLING APPARATUS

TECHNICAL FIELD

This invention generally relates to apparatus for physical strength competitions as between two or more players and, specifically, to machines for arm wrestling to test the arm and body strength as between two or more players. This invention also relates to recreational game apparatus for creating a more entertaining atmosphere when used in conjunction with arm wrestling machines.

BACKGROUND PRIOR ART

Arm wrestling machines are used to test the strength of the players of the machine as between one another, or as between one or more players and the machine itself. Though a machine is unnecessary for staging an arm wrestling contest, there are numerous advantages in using a machine.

When a machine is not used between two players, such factors as the size of the players' hands and the height of the players' arms and torso become important factors. These factors impair determining pure arm strength as between the players. Other factors such as the strength of a player's grip, strength of a player's wrist, and the ability to apply leverage to a player's body may also improperly influence deferring relative arm strength between players. A properly designed arm wrestling machine may eliminate these problematic intermediate factors which prohibit testing pure strength of the players. In addition, a machine could force the players to use better overall form in the contest and, thus, avoid injury to bones, joints, and muscles. However, many of the current designs do not assist in these problem areas.

Alternatively, when there are more than two players, a properly designed machine is not only advantageous, it is a necessity. As an example, a machine allows four individuals (players) to split up into two teams to compare the strength as between the two teams. Likewise, each team could consist of more than two players if the machines were extended to accommodate just such competition. Furthermore, combinations of unequally allotted teams could face each other to test strength of the overall teams. For example, a team of three players could compete against a team of two players. This type of configuration is well suited for competitions with an unequal number of players on each team.

For example, McCoy et al. U.S. Pat. No. 4,846,468, discloses a Team Arm Wrestling Machine which allows each team to be comprised of one or more players. McCoy discloses a series of levers and handle assemblies joined by shafts and a connecting linkage. Each player participates at a station, and each station for one team faces a station for the other team. The shafts extend between each set of facing stations and are rotatably connected to the levers and handle assemblies at the two facing stations. The handle and lever assemblies allow the player to interact with the machine. The connecting linkage links the shafts together so that the handle and lever assemblies at all of the stations move in unison.

One significant problem with the arm wrestling machine disclosed in McCoy is the configuration and external placement of the connecting linkage. The linkage is directly connected to the arm and lever assemblies and can come into contact with a player during operation. Specifically, a player's arm, hand, finger, or other extremity can come into contact with the connecting linkage as the lever and arm assemblies move back and forth. When the lever and arm assemblies move back and forth, their angle of orientation with respect to the connecting linkage varies. When the orientation angle changes, it is possible, and even likely, that a player's extremity, or other object, will get caught or pinched in between the connection between the lever and arm assemblies, and the connecting linkage. If a player's extremity gets caught, the player is susceptible to severe injury. If an object gets caught, the connecting linkage, and arm and lever assemblies are susceptible to considerable machine damage.

In addition, McCoy configures the arm wrestling machine with an arm stop working in conjunction with the arm and lever assemblies and the connecting linkage. This arm stop prevents the levers and hand assemblies from rotating more than a predetermined angle. Another significant problem with the McCoy arm wrestling machine is that the arm stop requires additional cumbersome and costly elements. These elements further cause the players to be susceptible to injury. This is particularly true when the arm stop fractures or is otherwise not functioning properly. Furthermore, the arm stop configuration is unnecessarily complicated as compared to the present invention.

Another problem of the design disclosed in McCoy is that of improper ergonomics. In McCoy, the lever and hand assembly combination will cause the player to exert a greater amount of pressure on his or her shoulder instead of the muscles of the player's arm. In particular, when a player's forearm is short, the arm support must be raised to accommodate the player. When this is done, the player's elbow moves in unison with the handles instead of staying stationary. Thus, the player must exert more force from his or her shoulder. This movement is unnatural and is contrary to at least one of the initial purposes of using an arm wrestling machine to begin with. Hence, prior to the development of the present invention, at least these problems existed in the art. The present invention solves these and other problems.

Arm wrestling machines are not only used in competition, these types of machines are also used in game rooms and arcades. Typically, an individual will want to test his or her overall strength. Several game room arm wrestling machines have been disclosed which will allow an individual to test his or her strength. Specifically, U.S. Pat. No. 929,281 to Brodeur, U.S. Pat. No. 948,140 to Johnson, U.S. Pat. No. 3,400,793 to Norris et al., and U.S. Pat. No. 4,805,900 to Sapp all disclose amusement apparatus for simulating arm wrestling and for testing arm strength. All of these disclosures include some means for determining arm strength in a scaled form. Although these configurations may be useful and amusing to the individual using the machine, only one player can participate at a time. In addition, there is no "winner" each time these arm wrestling simulators are used. Only the strength of one player is obtained from using the machine. If any kind of contest is undertaken, these arm wrestling simulators must be used more than once, and the scaled score from each player, representing the strength of that player, must be manually compared to obtain a "winner." Even then, the enthusiasm and excitement in such a game is likely meager as compared to a game or amusement apparatus in which the players are all playing at the same time to "win" the game. In addition, a game that only provides a scaled number value of a player's relative arm strength is also much less likely to provide enthusiasm and excitement as compared to a game which includes more of an element of chance. This is especially true when one player is significantly stronger than his opponent. The present invention solves these and other problems, as well.

SUMMARY OF THE INVENTION

The present invention is generally used for competitively matching the physical strength of two or more players.

According to the present invention, an arm wrestling machine having improved structure, ergonomics, safety features, and amusement features is achieved while reducing cost and increasing player and commercial functionality. Generally, the present invention includes a base for supporting the overall arm wrestling apparatus. A stand is fixedly secured to the base for supporting and/or housing several of the elements of the arm wrestling apparatus. A table portion is fixedly secured to and extends outwardly or generally perpendicular from the stand.

The arm wrestling machine of the present invention includes multiple arm wrestling stations. Each arm wrestling station includes a vertically adjustable elbow rest which is secured to the table portion and adapted for supporting the elbow of a player. Within the interior of the stand, a first arm rod is rotatably secured to the stand with mounting brackets and is aligned between the elbow rests of two of the stations, for transferring the forces exerted by one or more players along to the other players. The first arm rod internally extends through the stand and is connected to two arm bars, one at each end of the first arm rod. A second arm rod is also rotatably secured to the stand with mounting brackets and is aligned between the elbow rests for transferring the forces exerted by one or more players along to the other players. The second arm rod is aligned substantially in parallel with the first arm rod and internally extends through the stand. The second arm rod is also connected to two arm bars, one at each end of the second arm rod.

An arm bar is included at each station. Each arm bar is fixedly connected or secured to the ends of the first and second arm rods and has a handle pivotally mounted to the upper portion. This allows a player to change the player engagement angle with the arm bar. The handle generally accepts forces from the player and from the arm bar and also exerts forces on the player and the arm bar while in use.

To link the two or more arm rods together, couplers are mounted on the arm rods. A first coupler is fixedly mounted or secured to the first arm rod and is connected to a connector bar for accepting and exerting forces exerted and accepted by the first arm rod. A second coupler is also fixedly mounted or secured to the second arm rod and is also connected to the connector bar for accepting and exerting forces exerted and accepted by the second arm rod. Thus, the connector bar is movably linked to both the first and second arm rods through the first and second couplers, and movably mounted to the first and second couplers.

In addition, the connector bar has a first notch located toward one end of the connector bar and engages with the first coupler when the first and second arm rods rotate in one direction. The connector bar also has a second notch located toward the opposite end of the connector bar and engages the second coupler when the first and second arm rods rotate in the opposite direction.

Furthermore, the arm wrestling machine includes a locking assembly for directly halting and releasing the connector bar, and for halting and releasing the overall arm wrestling machine. The locking assembly includes a mounting plate for supporting the locking assembly and is fixedly connected to the stand and/or the table. The locking assembly also includes a locking pin positioned and designed to engage with the connector bar, a support fixedly attached to the mounting plate that has a bore for accepting and slidably supporting the locking pin, and a spring that is movably connected to the locking pin for biasing the locking pin in one direction. A lever is movably attached to the mounting plate at one end of the lever and is movably attached to the locking pin toward the other end of the lever. This permits force to be transferred to the locking pin and causes the pin to slide within the bore of the support.

The arm wrestling apparatus also includes a game portion. The game portion includes a generally planar surface pivotally disposed about a pivot point. The generally planar surface is coupled to the arm bar handles through a coupling means, and the coupling means transfers the forces exerted on the handles to the planar surface. The transferred forces cause the planar surface to pivot about the pivot point.

The game portion of the arm wrestling apparatus also includes at least one game piece and a game piece action area. The game piece action area includes the generally planar surface for operative interaction with the game piece. The game portion further includes a game piece escape portion for releasing the game piece from a first game piece wait area into the game piece action area. In addition, a first resulting area and a second resulting area are provided to accept the game piece after the game piece has travelled through the action area. The first and second resulting areas determine the winning player based on the ultimate position of the game piece.

Other features and advantages of the invention will be apparent from the following specification taken in conjunction with the following drawings.

DETAILED DESCRIPTION

Figure 1:
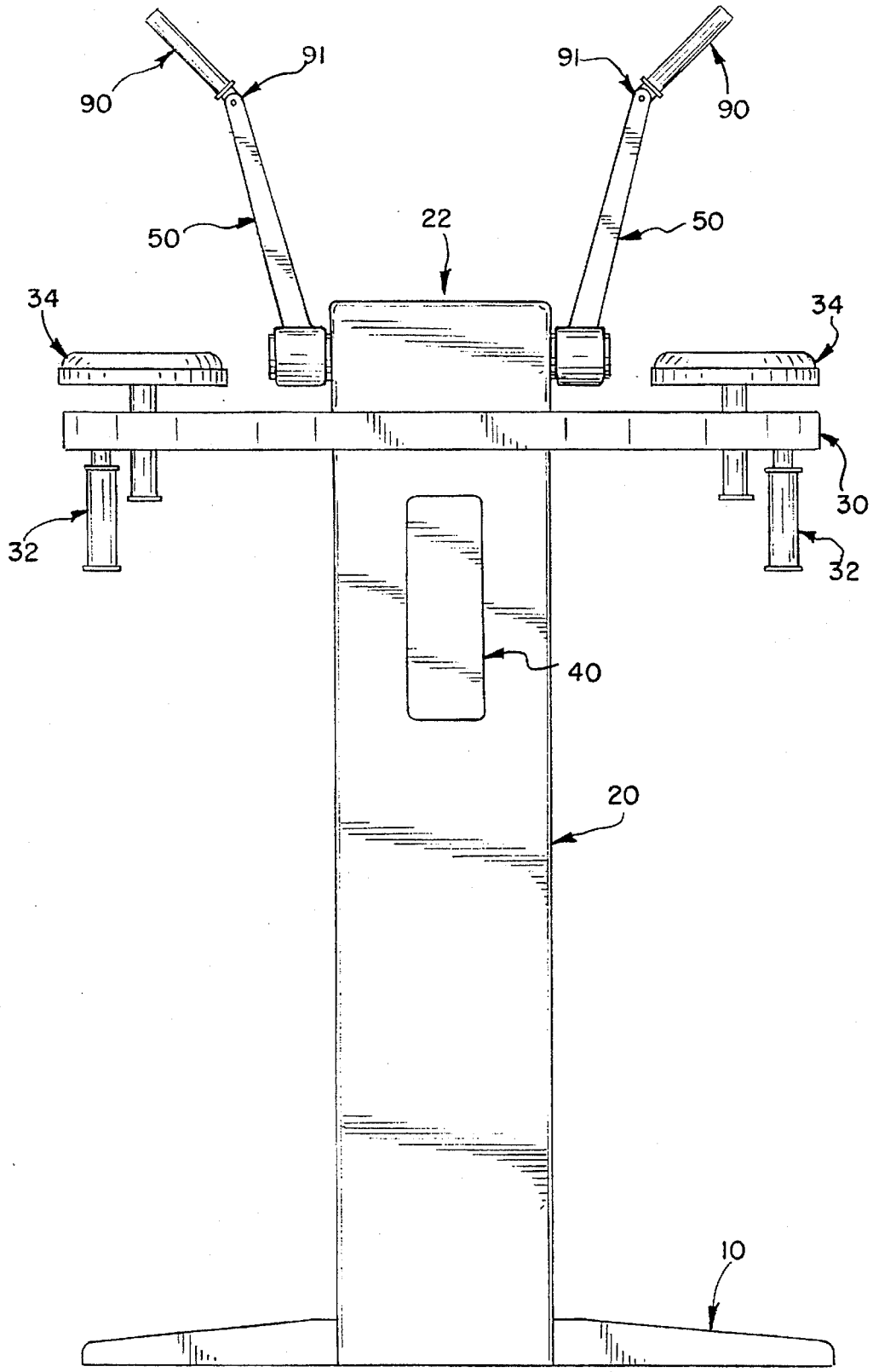
FIG. 1 is a side elevation of one embodiment of the arm wrestling machine of the present invention.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

Referring now to the drawings, FIG. 1 discloses an arm wrestling machine generally including a base 10, a stand 20, a table or table portion 30, elbow rests or elbow mats 34, a first arm rod 52*a*, a second arm rod 52*b*, a set of arm bars 50, a first coupler 56, a second coupler 58, and a connector bar 54. The first arm rod 52*a* is substantially parallel to the second arm rod 52*b*, and the first and second arm rods 52*a*, 52*b* are adapted for connection to at least one arm bar 50. In addition, the base 10 and stand 20 together form a means for supporting the table portion or support means, wherein the table portion 30 is fixedly secured to the support means. The upper surface of the table portion 30 can serve as a means for bracing the player's elbow, or as a support surface, when a player is using the arm wrestling apparatus. The upper surface of the elbow rests 34 can also serve as the means for bracing the player's elbow, or as a support surface, when a player is using the arm wrestling apparatus.

Figure 2:
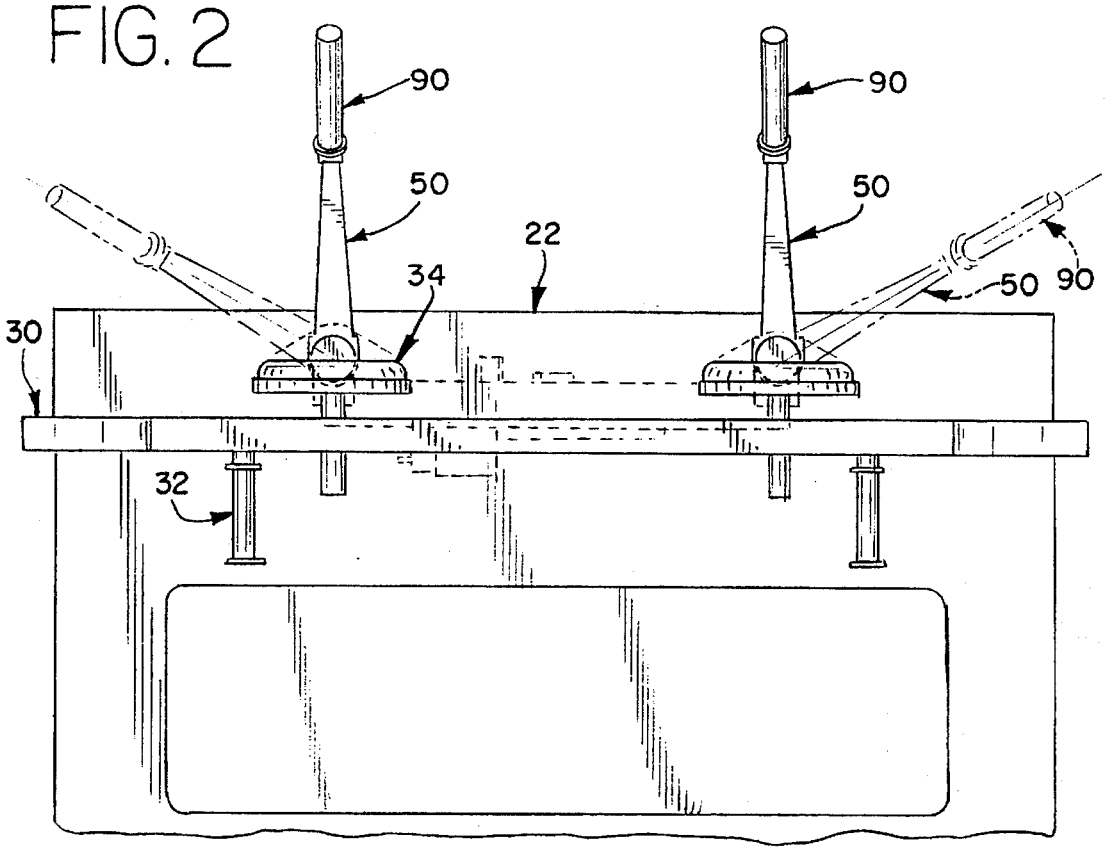
FIG. 2 is a front view of one embodiment of the present invention showing one arm bar substantially rotated in one direction and showing another arm bar substantially rotated in the opposite direction.
Figure 3:
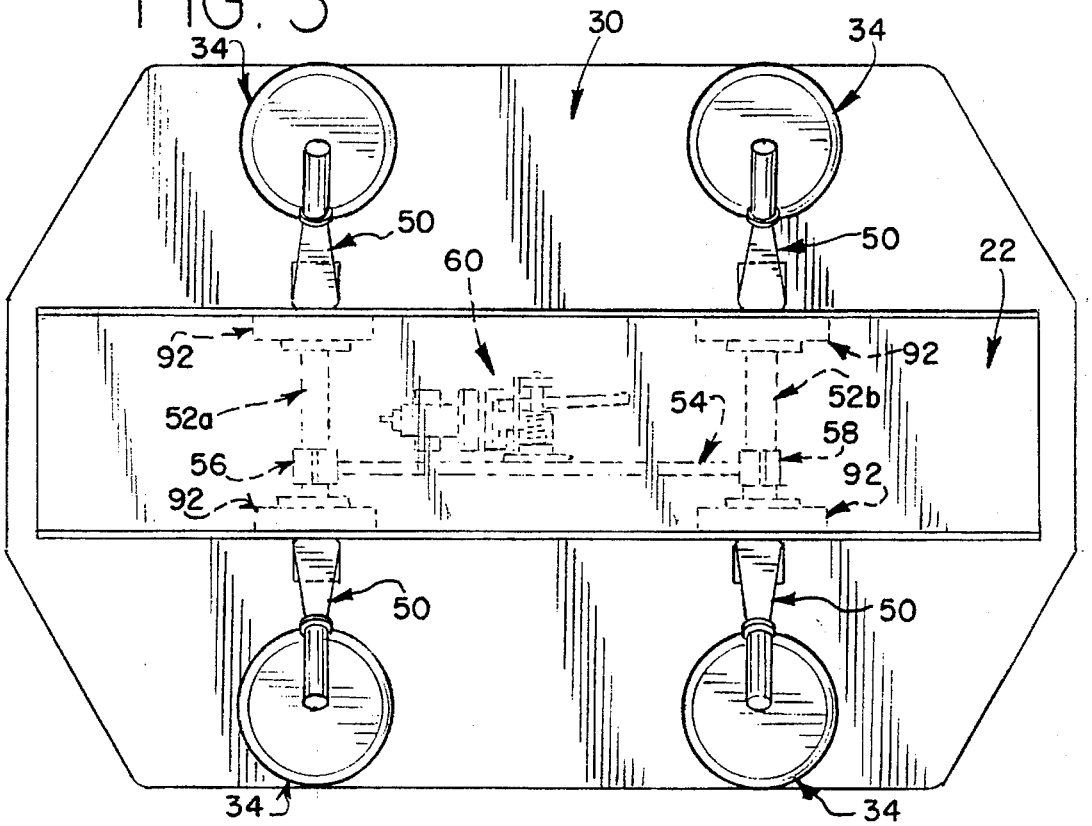
FIG. 3 is a top view of one embodiment of the present invention showing the internal components, including the arm rods, the couplers, the connector bar, and the locking assembly.

More specifically, referring to FIGS. 1, 2 and 3, a base 10 exists to support a stand 20 and the overall arm wrestling machine. The base 10 should be made of a sturdy material, such as metal or hard wood, so that there is sufficient support for the pressures that will be exerted on the remaining portions of the arm wrestling machine. A frictional material (not shown) can also be attached to the bottom of the base 10 so that the arm wrestling machine will not slide on surfaces on which the arm wrestling machine is placed. In addition, the base 10 can alternatively be bolted or otherwise fixedly attached to the surface on which the arm wrestling machine is placed to avoid the potentiality of sliding.

The stand 20 extends vertically from the surface on which the base is placed, and the stand 20 is fixedly attached or secured to the base 10 through a sturdy means of attachment. The base 10 and stand 20, among other things, are used for supporting the table portion 30. The stand 20 should also be made of a sturdy material in order to handle the forces and stresses of the arm wrestling machine while in use. The stand 20 houses and/or supports several elements of the arm wrestling machine. Specifically, the stand 20 houses a coin acceptor 40 (conceptually pictured in FIG. 1) which is used to initiate the arm wrestling machine when the arm wrestling machine is being used for commercial purposes. A table portion 30 extends outwardly in a horizontal or perpendicular direction from the stand 20 (parallel with the surface supporting the arm wrestling machine). The table portion 30 is fixedly secured to and extends outwardly or generally perpendicular from the stand 20. Each player participates in using the arm wrestling machine at an arm wrestling station. Each arm wrestling station can include a vertically adjustable elbow rest 34 which is secured to the table portion 30 and can be adapted for comfortably supporting the elbow of a player. Thus, the elbow rests 34 can serve as a means for bracing the player's elbow when a player is using the arm wrestling apparatus. Padding can be placed on the portion of the elbow rest 34 which comes into contact with the player's elbow or arm for a comfortable interaction between the player and the arm wrestling apparatus. Each arm wrestling station can also include a leverage gripper 32. The leverage gripper 32 as depicted in FIGS. 1 & 2 is located beneath the table portion 30 and attached thereto. Although it is preferred to attach the leverage gripper 32 beneath the table portion 30, the leverage gripper 32 can also be located above the table portion 30 and be attached thereto. The leverage gripper 32 should be attached to the table portion 30 in a sturdy manner in order to withstand the forces exerted on the leverage gripper 32 by the player.

Figure 4:
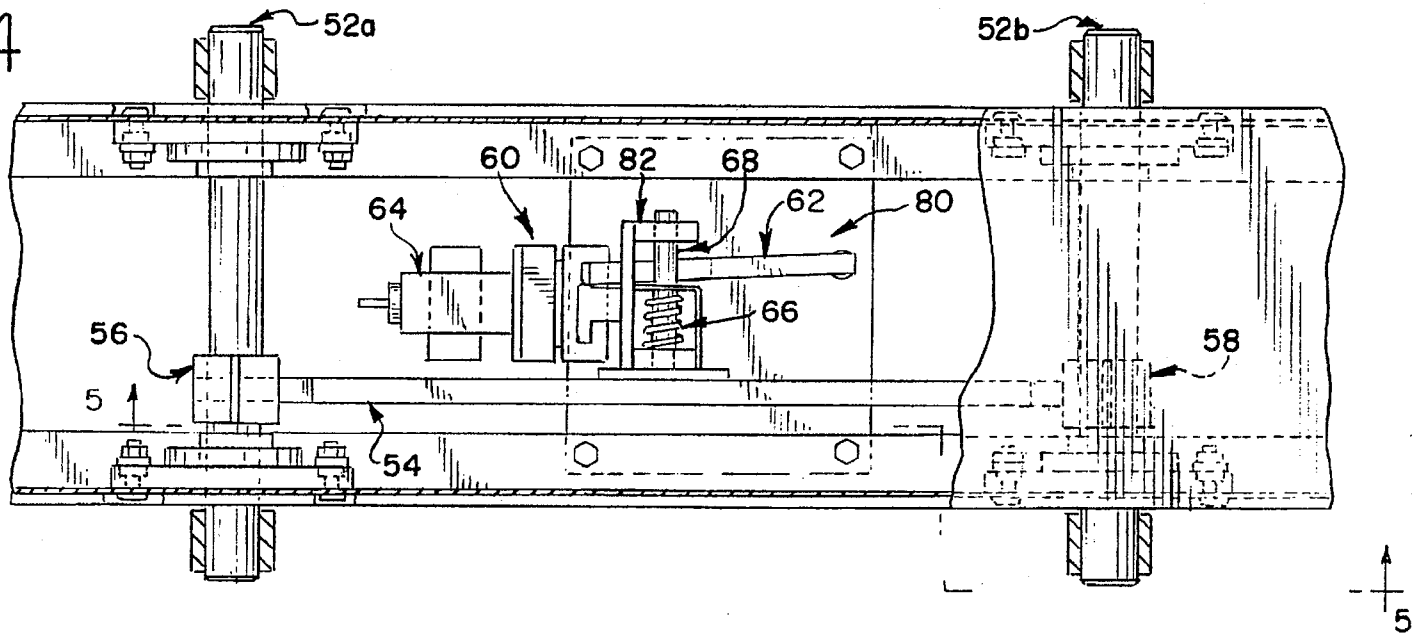
FIG. 4 is an enlarged top view of the internal portion of one embodiment of the present invention with the top of the stand substantially cut away to show more details of several elements shown in FIG. 3.
Figure 5:
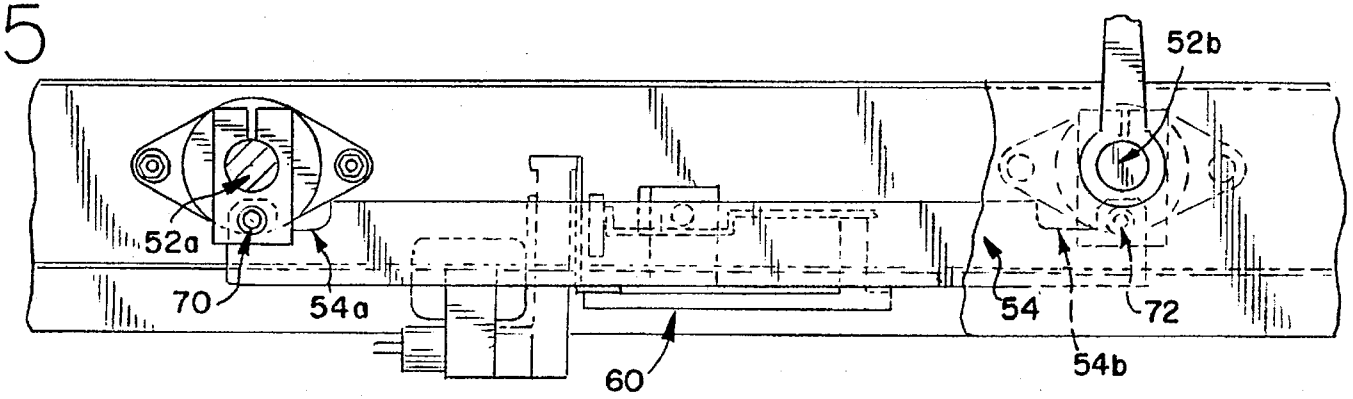
FIG. 5 is an enlarged front view of the internal portion of one embodiment of the present invention with the side of the stand substantially cut away to show additional details of those elements shown in FIG. 4.
Figure 6:
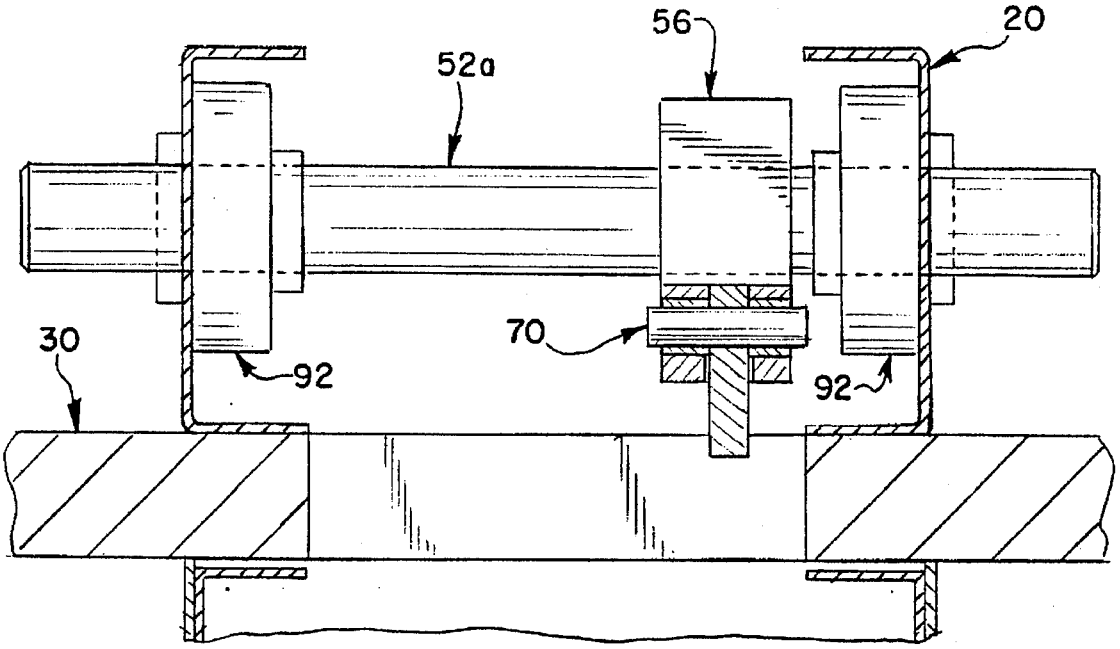
FIG. 6 is an enlarged sectional side view of the internal portion of one embodiment of the present invention showing the interplay between the stand, the table, the arm bars, and the mounting brackets.

Referring additionally to FIGS. 4, 5, and 6, within the interior of the stand 20, a first arm rod 52*a* is rotatably secured to the stand with mounting brackets 92 and is aligned between the elbow rests 34 of two of the stations. The first arm rod 52*a* is for transferring the forces exerted by one or more players along to the other players. The first arm rod 52*a* internally extends through the stand and is cooperatively connected to two arm bars 50, one at each end of the first arm rod 52*a*. Each arm wrestling station includes an arm bar 50, and the arm bars 50 at the respective stations move in unison with the respective arm rods 52.

A second arm rod 52*b* is also rotatably secured to the stand 20 with mounting brackets 92 and is aligned between the elbow rests 34 of two of the stations for transferring the forces exerted by one or more players along to the other players. The second arm rod 52*b* is aligned substantially in parallel with the first arm rod 52*a* and internally extends through the stand 20. The second arm rod 52*b* is also connected to two arm bars 50, one at each end of the second arm rod 52*b*.

Each arm bar 50 is fixedly connected or secured to the ends of the first and second arm rods 52*a* and 52*b*. Thus, a plurality of arm bars 50 are fixedly connected to the ends of the first and second arm rods 52*a*, 52*b* for accepting and exerting the forces exerted and accepted by the players. Each arm bar 50 has a handle 90 pivotally mounted to the upper portion of the arm bar 50 and allows the player to change the player engagement angle with the arm bar 50. Thus, a player can choose to keep his or her wrist straight as a direct extension of his or her arm, or the player may choose to bend his or her wrist and engage the handle 90 and arm bar 50 according to a more comfortable position. Using this pivoting handle 90 feature also will allow the player to comfortably adjust the bend of his or her arm to most comfortably engage the handle 90 and arm bar 50. Thus, the player can adjust his or her angle of engagement to obtain the most beneficial engagement with the handle 90 and arm bar 50. The handle 90 generally accepts forces from the player and from the arm bar 50 and also exerts forces on the player and the arm bar 50 while in use.

In order to link the two or more arm rods 52*a* and 52*b* together, couplers 56 & 58 are mounted on the arm rods 52*a* & 52*b*, respectively. Specifically, a first coupler 56 is fixedly mounted or secured to the first arm rod 52*a* and is connected to a connector bar 54. The first coupler 56 is for accepting and exerting forces exerted and accepted by the first arm rod 52*a*. A second coupler 58 is also fixedly mounted or secured to the second arm rod 52*b* and is also connected to the connector bar 54. The second coupler 58 is for accepting and exerting forces exerted and accepted by the second arm rod 52*b*. Thus, the connector bar 54 is movably linked to both the first and second arm rods 52*a*, 52*b* through the first and second couplers 56, 58, and are cooperatively connected to the first and second couplers 56, 58. This cooperative connection can be achieved by first and second connector pins 70, 72 as depicted in FIGS. 5 & 6. A bore is carved out within each of the two couplers 56, 58 and one at each end of the connector bar 54 to accommodate the first and second connector pins 70, 72. The first connector pin 70 links or connects one end of the connector bar 54 to the first coupler 56, and the second connector pin 72 links or connects the opposite end of the connector bar 54 to the second coupler 58.

FIG. 2 shows one arm bar 50 substantially rotated in one direction and shows another arm bar 50 substantially rotated in the opposite direction. Based on the arm wrestling machine design, this depiction cannot happen simultaneously. Thus, when one arm bar 50 is rotated in one angular direction, the other arm bar 50 will also be rotated in the same direction and in substantially the same angle of rotation. FIG. 2 only depicts the possible rotation of the arm bars 50 in both directions. The handles 90 are attached to the arm bars 50, and are spaced apart a distance which is great enough to allow very husky players to play the game without bumping into one another. Each of the handles 90 are likewise movable in a first direction and a second direction with the arm bars 50. In addition, each of the handles 90 are disposed a distance from the support surface, 30 or 34, to permit the players to grasp a respective handle 90 and to rest an elbow on the support surface, 30 or 34. The joints 91 between the arm bars 50 and handles 90 (see FIG. 1) allows for the requisite adjustment of this distance for players with shorter or longer forearms.

FIGS. 4 & 5 also depict that the connector bar 54 has a first notch **54*a* that is functionally located toward one end of the connector bar 54. The first notch 54*a* engages the first coupler 56 when the first and second arm rods 52*a*, 52*b* rotate in one direction. The connector bar also has a second notch 54*b* that is also functionally located toward the opposite end of the connector bar 54. The second notch 54*b* engages the second coupler when the first and second arm rods 52*a*, 52*b* rotate in the opposite direction. The placement and size of the first and second notches 54*a*, 54*b* will vary according to the determination of how many degrees the arm bars 50 should be allowed to rotate without stoppage. If the notches 54*a*, 54*b* are deeper, the notches 54*a*, 54*b* will need to be extended further into the center of the connector bar 54 because the arm bars 50 will rotate further with deeper notches 54*a*, 54*b*. Thus, based on a predetermination of the required angle of deflection of the arm bars 50, the notches 54*a*, 54*b*** should be adjusted accordingly.

Furthermore, the arm wrestling machine includes a locking assembly 60 for directly halting and releasing the connector bar 54, and, thus, for halting and releasing the overall arm wrestling machine. The locking assembly includes a mounting plate 80 (FIG. 4) for supporting the locking assembly 60. The mounting plate 80 can be fixedly connected to either the stand 20 or the table 30.

The locking assembly 60 also includes a locking pin 68 that is positioned and designed to engage with the connector bar 54. A support 82 is also fixedly attached to the mounting plate 80 and has a bore for accepting and slidably supporting the locking pin 68. Furthermore, a locking spring 66 is movably connected to the locking pin 68 for biasing the locking pin 68 in one direction. A lever 62 is movably attached to the mounting plate 80 at one end of the lever 62 and is movably attached to the locking pin 68 toward the opposite end of the lever 62. The lever 62 is used for transferring force to the locking pin 68 and for causing the locking pin 68 to slide within the bore of the support 82. The locking pin 68 halts and releases the connector bar 54. The locking assembly also includes a controller 64 that is adapted to receive a signal from the coin acceptor 40 which causes the controller to exert or remove forces on the lever 62.

Figure 7:
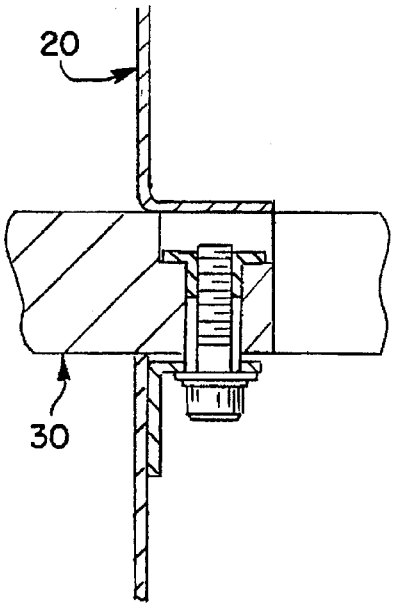
FIGS. 7 & 8 are enlarged side sectional views of one embodiment of the present invention depicting alternative bolting configurations.
Figure 8:
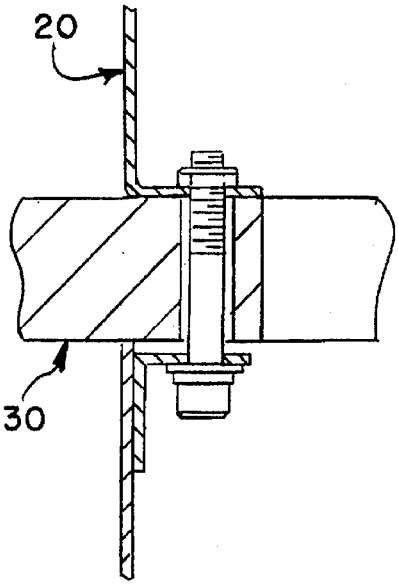

FIGS. 7 and 8 depict possible connection methods which can be used to provide a sturdy connection between the stand and the table.

Figure 9:
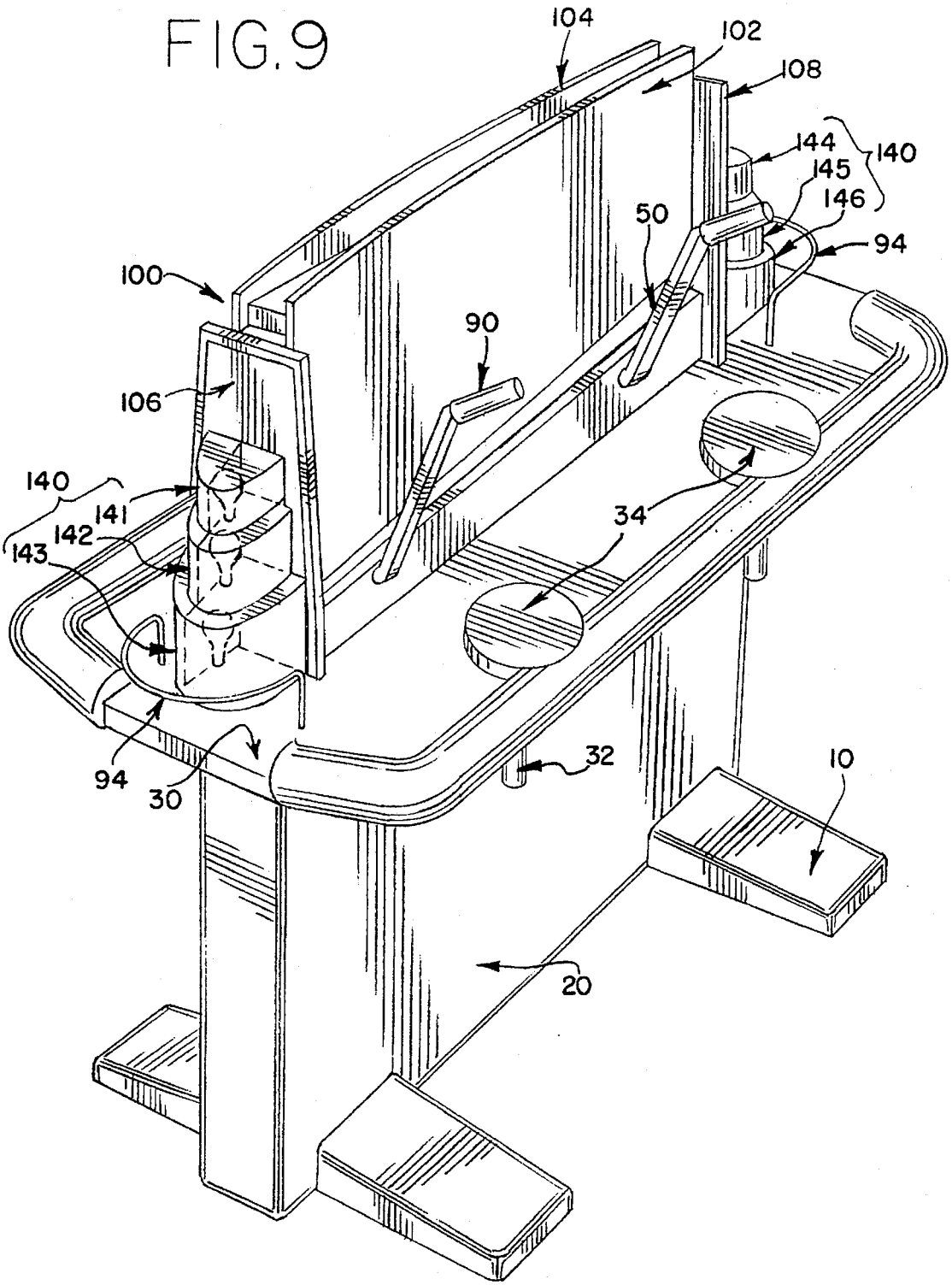
FIG. 9 is a perspective view of another embodiment of the present invention that includes a game portion.

FIG. 9 is a perspective view of an alternative embodiment of the arm wrestling apparatus which includes a game portion or apparatus 100. In addition to the main elements of the arm wrestling apparatus embodiment from FIGS. 1–3, the game portion 100 within FIG. 9 includes several elements. The game portion 100 includes a first transparent cover 102 and a second transparent cover 104. These covers 102, 104 are provided to allow a player to see within the game portion 100 while keeping the interior of the game portion enclosed. The game portion also includes a first side portion 106 and a second side portion 108 additionally for keeping the interior of the game portion 100 enclosed.

A plurality of indicators 140 are provided to indicate to the players particular information concerning the state of the game, motivational interjections, and other informative indications. Specifically, a first indicator 141, a second indicator 142, a third indicator 143, a fourth indicator 144, a fifth indicator 145, and a sixth indicator 146 are attached to the side portions 106, 108. Particular indications can include "Win," "You're a Champ," "Insert Coin," "Better Luck Next Time," "Try Again," "Game Over," and other indications. Guard rails 94 are provided to protect the indicators 140 from damage, and are attached to the table top 30.

Figure 10:
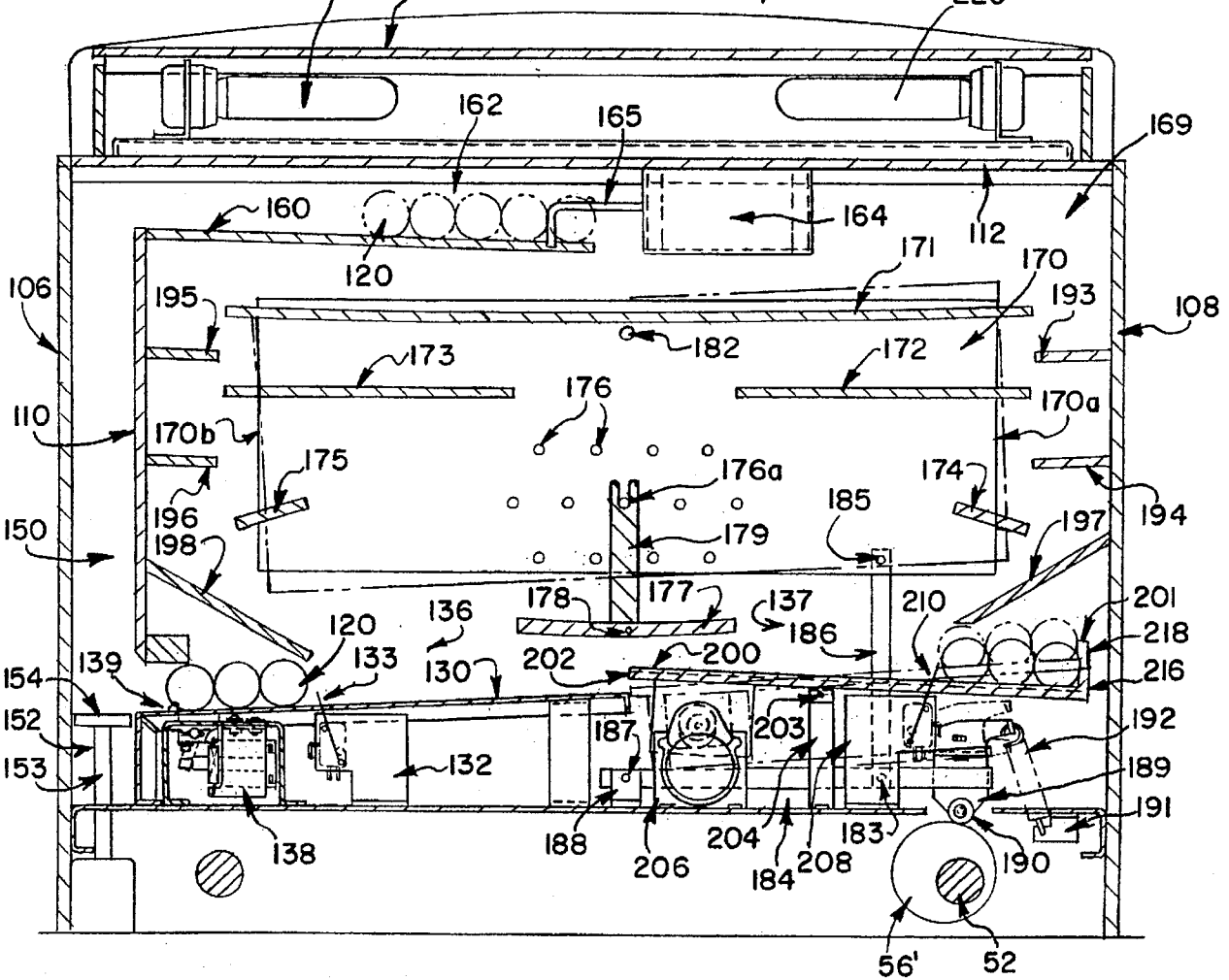
FIG. 10 is a cut-away front view of the game portion of one specific embodiment of the present invention depicting the internal elements of the game portion.

FIG. 10 is a cut-away front view of the game portion 100 of one specific embodiment of the arm wrestling apparatus depicting the internal elements of the game portion. The game portion in FIG. 10 includes several internal elements. Specifically, the game portion 100 operation area is defined by a first exterior wall 106, a second exterior wall 108, and a top exterior wall 114, with the arm wrestling apparatus from FIGS. 1–3 supporting the game portion of FIG. 10. The game portion 100 also includes an action area 169 which is generally defined by a first interior wall 110, a second interior wall 108, a top conveyor 160 and a top interior wall 112.

The game portion 100 also includes a plurality of game pieces 120. The game pieces 120 operatively interact with the action area 169 and other areas of the game portion 100. The game portion 100 further includes a game piece escape portion 164 for releasing the game piece 120 from a first game piece wait area 162 into the game piece action area 169. The game pieces 120 are supported by the top conveyor 160 while the game pieces wait to be released into the action area 169. The game piece escape portion 164 includes an escape lever 165 for releasing the game pieces into the action area 169.

Several signal arrangements can be used to signal the game piece escape portion 164 to cause the game piece escape lever 165 to release a game piece into the action area 169. Specifically, a timer could be used to signal to the escape portion 164 to release game pieces at particular time intervals during a game (i.e.—one game piece 120 at the beginning of the game, and then one every twenty seconds thereafter until the end of the game). Alternatively, the arm wrestling apparatus could be configured to signal the escape portion 164 to release a game piece 120 every time the previous game piece 120 has dropped through the action area 169, until the game is over. The game piece action area includes a plurality of support racks mounted on a central support 170; the central support 170 and support racks being pivotable about a center of rotation or central pivot point 182, the game piece 120 operatively interacting with the support rack.

Thus, the game piece action area 169 includes a generally planar surface or support rack that is pivotally disposed about the central pivot point 182 for operative interaction with the game piece 120. The generally planar surface in FIG. 10 can be the upper surface of each of the first support rack 171, the second support rack 172, the third support rack 173, the fourth support rack 174, and/or the fifth support rack 175. The plurality of support racks 171, 172, 173, 174, and 175 are all pivotally and rotatably disposed about the central pivot point 182. The central support 170 also includes a plurality of pins 176 mounted on the central support 170. These pins 176 will randomly cause the game piece 120 to generally move in the direction of either the first support side 170*a* or in the direction of the second support side 170*b*. In other words, the game piece 120 will bounce off of the pins 176 in a random fashion.

A plurality of fixed racks 193, 194, 195, and 196, and a plurality of fixed slides 197 and 198 are provided within the game piece action area 169 for controlling the flow of the game piece 120 through the game piece action area 169. First fixed rack 193, second fixed rack 194, and first fixed slide 197 are fixedly attached to second interior wall 108. Likewise, third fixed rack 195, fourth fixed rack 196, and second fixed slide 198 are fixedly attached to first interior wall 110.

The game apparatus further includes a swing rack 177 which is rotatably and pivotally connected to the central support 170. Specifically, the swing rack 177 is fixedly attached generally perpendicular to rack mount 179. Both the central position of the swing rack 177 and one end of the rack mount 179 are pivotally attached to rack pivot 178. The opposite end of the rack mount 179 has a groove which encompasses central pin 176*a*. When the central support 170 pivots or rotates about the central pivot point 182, the grove end of rack mount 179 cooperatively moves back and forth with the central pin 176*a*. Because the opposite end of the rack mount 179 is fixed about the rack pivot 178, the movement of the groove end of the rack mount with central pin 176*a* will cause the swing rack 177 to pivot about rack pivot 178. Thus, for example, when the central support 170 pivots or rotates about the central pivot point 182 in a clockwise direction, the swing rack 177 will pivot or rotate about the rack pivot 178 in a counter-clockwise direction, and vice versa. The swing rack 177 is generally used for causing the game piece 120 to randomly fall into either a first resulting area 136 or a second resulting area 137.

The first resulting area 136 is provided for the collection of game pieces 120. The game pieces 120 end up being collected by the first resulting area 136 when one player, or team of players, attempts to control the flow of game pieces 120 within the action area 169 which will be explained in detail below. Thus, the first resulting area 136 accepts the game pieces 120 when the game pieces 120 fall into the first resulting area 136. The first resulting area 136 also includes a first conveyor 130 that is tilted in one direction. The tilt direction of the first conveyor 130 in FIG. 10 is toward an elevator shaft 150. The first conveyor 130 accepts the game piece 120 when the game piece 120 falls onto the first conveyor 130. The first resulting area 136 further includes a first rotary switch 132 for keeping track of when the game piece 120 falls within the first resulting area 136 and onto the first conveyor 130. It is to be understood that this switch may be in various forms, including, but not limited to, the mechanical switch shown or an optical switch. The first rotary switch 132 includes a first switch lever 133 which extends into the path of the game piece 120 when the game piece is rolling down the tilt of the first conveyor 130. Thus, each time a game piece 120 lands on the first conveyor 130, the game piece 120 rolls down the tilt of the first conveyor 130, and runs into the first rotary switch lever 133, thereby switching the first rotary switch 132. The first resulting area also includes a game piece release portion 138 which keeps the game pieces 120 from entering into the elevator shaft 150 until the proper time. The release portion 138 includes a release lever 139 which also extends into the path of the game piece 120 when the game piece is rolling down the tilt of the first conveyor 130. However, the release lever 139 does not allow the game piece to pass until the release lever 139 is lowered below the surface of the first conveyor 130.

The second resulting area 137 is also provided for the collection of game pieces 120. The game pieces 120 end up being collected by the second resulting area 137 when one player, or team of players, attempts to control the flow of game pieces 120 within the action area 169 which will be explained in detail below. Thus, the second resulting area 137 accepts the game pieces 120 when the game pieces 120 fall into the second resulting area 137. The second resulting area 137 also includes a second conveyor 200 that can be tilted and positioned in several directions and positions. The game tilt direction, or game position 216, of the second conveyor 200 in FIG. 10 is away from the elevator shaft 150 and the reset tilt direction, or reset position 218, of the second conveyor 200 in FIG. 10 is toward the elevator shaft 150. The second conveyor 200 accepts the game piece 120 when the game piece 120 falls onto the second conveyor 200. The second resulting area 137 further includes a second rotary switch 208 for keeping track of when the game piece 120 falls within the second resulting area 137 and onto the second conveyor 200. The second rotary switch 200 includes a second switch lever 210 which extends into the path of the game piece 120 when the game piece is rolling down the game tilt, or tilt of the game position 216, of the second conveyor 200. Thus, each time a game piece 120 lands on the second conveyor 200, the game piece 120 rolls down the game tilt 216 of the first conveyor 130, and runs into the second rotary switch lever 210, thereby switching the second rotary switch 208. The game pieces 120 stop rolling down the game tilt 216 when the game piece reaches a stopper end 201 of the second conveyor 200 which is disposed on the second conveyor 200 furthest away from the elevator shaft 150 within FIG. 10. Until the game is reset, the game pieces which fall onto the second conveyor 200 accumulate towards the stopper end 201 of the second conveyor 200. Thus, while the game is being played by the players, the tilt direction of the first conveyor 130 is in the opposite direction from the tilt direction (game tilt or game position 216) of the second conveyor 200. Furthermore, the first and second resulting areas 136, 137 determine the winning player based on the ultimate position of the game piece 120 through first and second rotary switches 132, 208, respectively, as will be explained further below.

The second resulting area 137 also includes a motor 206 for tilting the second conveyor 200 about conveyor pivot 203 from the game position 216 to the reset position 218, and vice versa. The second conveyor 200 is generally supported by a conveyor support 204, and the second conveyor 200 is tiltably or rotatably connected to conveyor support 204 with a pin at the conveyor pivot 203 at a generally central location on the second conveyor 200. The motor 206 is fixedly attached toward a central end 202 of the second conveyor 200, and is also fixedly attached to a stationary location within the arm wrestling apparatus. When the motor 206 is engaged, it will either raise or lower the central end 202 of the second conveyor 200, thereby lowering or raising, respectively, the stopper end 201 of the second conveyor 200, all while the second conveyor 200 is tilting or rotating about conveyor pivot 203.

Also generally located within the second resulting area 137 is a means for integrating the game portion 100 of the arm wrestling apparatus with the remaining portion of the arm wrestling apparatus. Specifically, the integration means in FIG. 10 includes a first mounting block 188 fixedly attached to a stationary portion of the arm wrestling apparatus. A first pivot bar 184 is tiltably or rotatably connected to the first mounting block 188 at one end of the first pivot bar 184 with a pin at the pivot point 187. The first pivot bar 184 can be raised and lowered about the pivot point 187. A connector block 189 is adjustably connected to the opposite end of the first pivot bar 184 for direct integration with the arm bars 50 and arm rods 52. Specifically, the connector block 189 includes a roller 190 attached to a lower end of the connector block 189, and the roller 190 rolls about an outer surface of a wheel 56' which can be coupled to an arm rod 52 similar to the couplers 56, 58. However, the outer surface of the wheel 56' may not a perfect circle. If the outer surface of the wheel 56' is a perfect circle, the arm rod 52 should be offset from the center of the wheel 56' (as shown in FIG. 10). In the alternative, the outer surface of the wheel 56' can take the shape of an oval. The wheel 56' is coupled to the arm rod 52 such that when the arm rod 52 rotates, the wheel 56' will also rotate with the arm rod 52, and the connector block 189 will move up and down in response thereto. More particularly, when the wheel 56' rotates, the roller 190 rolls about the outer surface of the wheel 56', and since the center of the wheel 56' is offset, this will cause the roller 190 to move up and down, thereby moving the connector block 189 up and down as well. A spring 192 is connected to a stationary spring mount 191 and is also connected to the connector block 189, for keeping the roller 190 in continuous contact with the outer surface of the wheel 56'. Thus, the first pivot bar 184 will pivot about the pivot point 187 at one end, and will move up and down with the connector block 189 at the other end, when the wheel 56' is rotated.

One end of a second pivot bar 186 is linked to a generally central location on the first pivot bar 184 at a first link point 183 with a pin. The other end of the second pivot bar 186 is linked to a point towards the first support side **170*a* of the central support 170 with a pin at a second link point 185. These second pivot bar 186 links or connections 183, 185 integrally and movably connect the central support 170 to the first pivot bar 184, and, thus, integrally and movably connect central support 170 to the arm rod 52**.

As a summary and application of these integration means, the arm wrestling apparatus includes a means for coupling the handles 90 to the planar surface 171, 172, 173, 174, and/or 175. In the embodiments of FIGS. 3 and 10 combined, this coupling means includes a path of force starting with the forces accepted by the players and exerted on the handles 90, following along the arm bars 50, the arm rods 52, the wheel 56', the connector block 189 and the first and second pivot bars 184, 186, and the central support 170 including the planar surface or support racks 171, 172, 173, 174, and/or 175. Hence, the coupling means of FIGS. 3 and 10 combined includes a plurality of arm bars 50 adjustably connected or linked to the respective handles 90 for accepting and exerting the forces exerted and accepted by the players. The plurality of arm rods 52 are provided for connection to the arm bars 50, and the connector bar 54 is provided for linking one or more arm bar 50 to one or more other arm bars 50. The pivot bars 184, 186 are provided for linking the arm bars 50, along with the connector bar 54, to the planar surface 171, 172, 173, 174, and/or 175. The pivot bars 184, 186 accept and exert the forces exerted and accepted by the arm bars 50 and the connector bar 54, and the pivot bars 184, 186 transfer these forces to the planer surface 171, 172, 173, 174, and/or 175. Thus, the planar surface 171, 172, 173, 174, and/or 175 is thereby coupled or linked to the handles 90, and the coupling means transfers forces, exerted on the handles 90 to the planar surface 171, 172, 173, 174, and/or 175. The transferred forces will cause the planar surface 171, 172, 173, 174, and/or 175 to pivot about the central pivot point 182.

The game portion 100 also includes the elevator shaft 150 for raising the game pieces 120 from the first resulting area 136 to the first wait area 162. An elevator assembly 152 is provided for the same purpose. Specifically, the elevator assembly 152 includes a lift 153, and a platform 154 for raising the game pieces 120 from the first resulting area 136 to the first wait area 162. The platform 154 is integrally connected to the lift 153, and the lift raises and lowers the platform 154 within the elevator shaft 150. The elevator assembly 152 is configured such that the platform 154 will accept a game piece 120 at the bottom of the elevator shaft 150, and the platform 154 will raise the game piece 120 to the top of the elevator shaft 150. At the top of the elevator shaft 150, the platform 154, and elevator assembly 152, releases the game piece onto the top conveyor 160 and the game piece rolls into the first wait area 162. Lamps 220 are provided as a means for illuminating the game portion 100.

Figure 11:
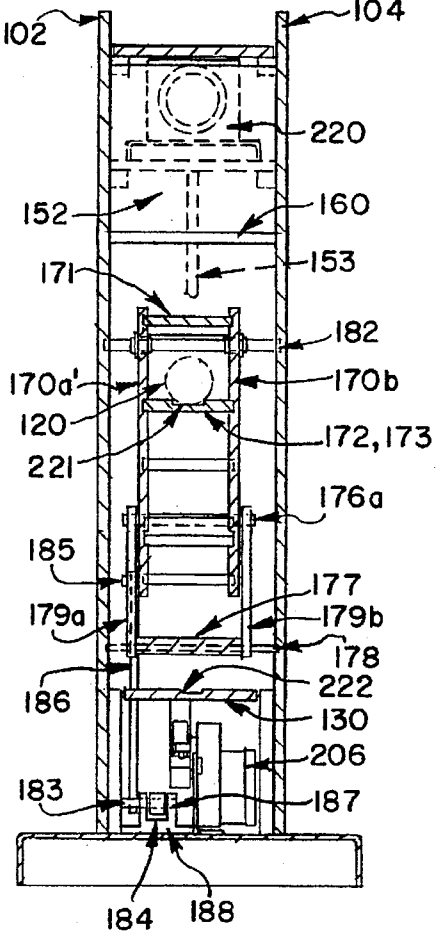
FIG. 11 is a sectional side view of the game portion of the embodiment of the present invention from FIG. 10, also depicting the internal elements of the game portion.

FIG. 11 depicts the game portion 100 of the embodiment from FIG. 10 showing a sectional side view of several elements of the game portion 100. Specifically, the game portion 100 in FIG. 11 shows the lamp 220 for illuminating the game portion 100. FIG. 11 also shows a portion of the lift 153 of the elevator assembly 152 within the elevator shaft 150 (the remaining portion is not shown). Furthermore, FIG. 11 shows the first and second transparent covers 102, 104, respectively, which are not shown in FIG. 10. The central pivot point 182, the rack pivot 178, and the top conveyor 160 are integrally attached to and supported by these first and second covers 102, 104. Integrally attached to the central pivot point 182 is the central support 170 which includes a first central pivoting support **170*a*' and a second central pivoting support 170*b*'. These central pivoting supports 170*a*', 170*b*' support the first support rack 171, the second and third support racks 172, 173, and several of the other racks from FIG. 10 as is shown. A game piece 120 is shown within a first groove 221 within the second and third support racks 172, 173**. Several other racks can be made with similar grooves as well.

The rack pivot 178 cooperatively supports the swing rack 177 as described above, and the central pin **176*a* fits into grooves (not shown) within a first rack mount 179*a* and a second rack mount 179*b*. Conveyor 130 or 200 is shown with a second groove 222 for accepting the game piece 120. Without limitation, the game piece 120** can be a ball of different sizes.

FIG. 11 also shows the first central pivoting support **170*a*' linked to the second pivot bar 186 through second link point 185. The second pivot bar 186 is further linked to the first pivot bar 184 through the first link point 183, as previously described. FIG. 11 further depicts the first pivot bar 184 linked to the mounting block 188 through the pivot point 187. The motor 206 is also shown for tilting the second conveyor 200 about conveyor pivot 203 from the game position 216 to the reset position 218**, and vice versa, as previously described.

Figure 12:
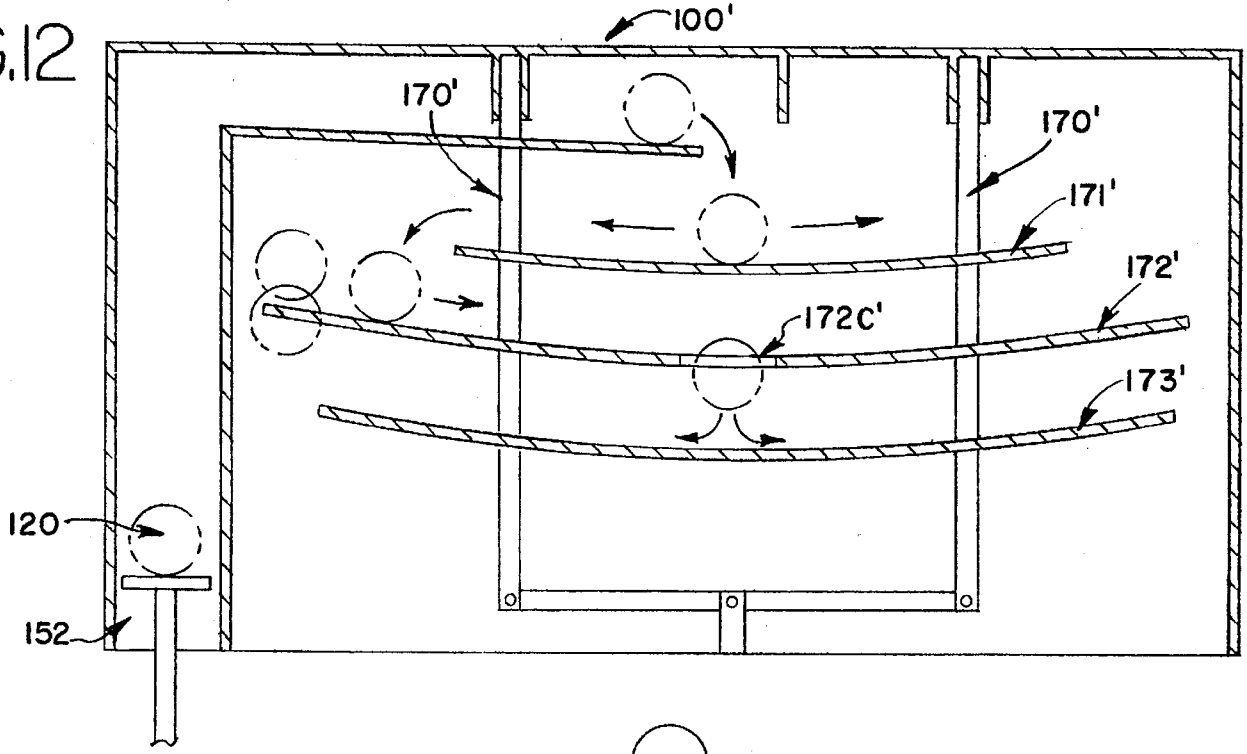
FIG. 12 is a partial cut-away front view of the game portion of a further specific embodiment of the present invention depicting some of the differing internal game portion elements as compared to the embodiment disclosed in FIGS. 10 and 11; and, FIG. 13 is a perspective view of a portion of the further embodiment shown in FIG. 12.

FIG. 12 shows a partial cut-away front view of another embodiment of the game portion 100 from FIGS. 10 and 11.

Figure 13:
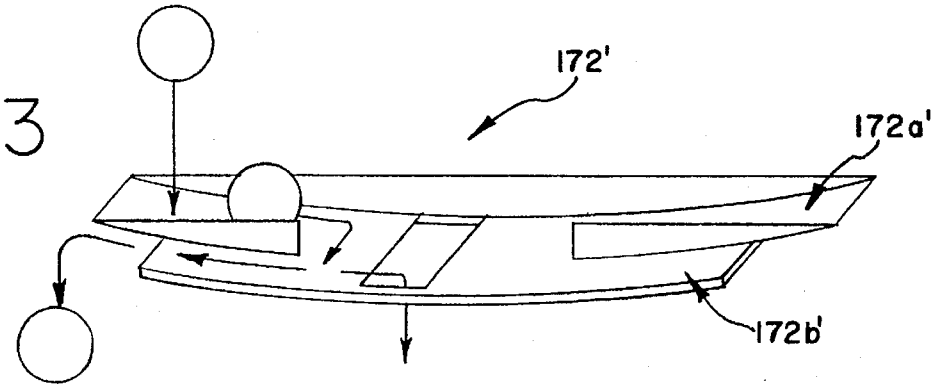

Specifically, FIG. 12 depicts a game portion 100' which includes a central support system 170' which is integrally connected to the rest of the arm wrestling machine in a similar fashion as the game portion 100 form FIGS. 10 and 11. However, the central support system 170' within the game portion 100' includes an upper support rack 171', a central support rack 172', and a lower support rack 173' for interaction with the game piece 120. These racks 171', 172', and 173' pivot about a center of rotation, or pivot point, when the players exert forces on the arm bars 50 (FIG. 1) in a similar fashion as the game portion in FIGS. 10 and 11. The central rack 172' depicted in FIG. 13 includes a first track **172*a*', a second track 172*b*', and a drop hole 172*c*' across both tracks 172*a*', 172*b*' at a central location within the central rack 172'. The drop hole 172*c*' will allow a game piece to drop down to the lower support rack 173'**.

In operation, the arm wrestling apparatus of FIGS. 1 through 5 works as follows. When two or more players are using the arm wrestling apparatus, the players should line up at stations that are opposed to one another. However, if odd numbered teams of players exist, not all players will see a player across from them at an opposing station. The players then place their elbow on an elbow mat 34 at their station, and grab a respective handle 90. A coin is placed into the coin acceptor 40 when the apparatus is being used in a commercial setting. A start button (not shown) is then pushed. The players can then grab a respective leverage gripper 32 with their opposite hand, if the players so choose, for leveraging forces to be applied to the handle 90. The arm bars 50 will usually be set at a substantially vertical position before the game begins.

Once the game begins, the players on one side of the apparatus apply forces to the handle to force the handle 90, and thus, the arm bar 50, in one direction. The players at opposing stations apply forces to their handles 90 in the opposite direction. When the arm bars 50, and arm rods 56 are at a preselected angle of rotation, a point or increase in score will be given to the players on the side that won the battle of the forces. The arm bars 50 will then automatically be reset to their vertical position, and the players will play again, until a score is given to one side (one or more players), or until the game is over.

While the game is being played, all of the arm bars 50 of the apparatus are maintained in a substantially parallel configuration. The arm bars 50 cannot be rotated past a preselected angle because the first notch **54*a* or second notch 54*b* will rise and meet the respective arm rods 52*a*, 52*b* when the arm bars have been rotated to a preselected angle. This angle can be set as the win or score angle, or the win or score angle could be set at position before this preselected angle is reached. A switch can be internally located to indicate to a controller (a microprocessor) such a position. A controller can also be used to coordinate all other timing, scoring, and electrical and electro-mechanical operation as one of skill in the art would understand. When the game is over, the locking mechanism 60 locks the connector bar 54, and thus, the arm bars 50**, in a preselected position.

The game portion 100 within FIGS. 10 and 11 operates as follows. When the game begins (a coin is inserted and the start button is pressed), game piece escape portion 164 will release a game piece 120 from the first wait area 162 down into the action area 169. Specifically, a game piece 120 will drop down onto the planar surface of the first support rack 171 which is supported by the central support 170. At this point, the players will attempt to cause the central support 170 to pivot about central pivot point 182 (center of rotation) in either a clockwise or counter-clockwise direction, depending on which direction is favorable to the player(s). The game piece 120 will then roll or move toward either the first support side **170*a* or toward the second support side 170*b*, depending on the rotation of the central support 170 about the central pivot point 182. When the game piece gets to one end of the first support rack, the game piece will drop down onto either the first or third fixed support rack 193, 195. The game piece will then drop onto either the second or third support racks 172, 173, and the players will continue to exert forces on the handle 90 to get the central support to rotate or pivot about the central pivot point 182 in a favorable manner. The game piece 120 will ultimately make its way down to either the first or second resulting areas 136, 137 with the first and second switches 132, 208 keeping track of the number of game pieces 120 entering each resulting area 136, 137. Another game piece 120 will be released into the action area 169 while or after the previous game piece 120 is flowing through the action area 169, until the game is over and a winner has been decided from the number of game pieces 120 in each resulting area 136, 137**.

Once the game is over, a reset operation takes place and includes the following. The second conveyor 200 is pivoted from a game position 216 to a reset position 218 with the operation of motor 206. The game pieces will then flow from the second resulting area 137 to the first resulting area 136. Simultaneously or afterwards, the game piece release portion 138 releases one game piece into the elevator shaft 150 and onto the platform 154 for raising this game piece 120 back to the first wait area 162. The platform 154 is then lowered to the bottom of the elevator shaft 150 and another game piece 120 is raised back to the first wait area 162. This operation takes place until all of the game pieces 120 are back in the first wait area 162.

In operation, the game portion 100' embodiment in FIG. 12 works in a similar fashion as the game portion 100 embodiment from FIGS. 10 and 11. Specifically, when a game piece 120 is released onto the upper support rack 171', the players try to rotate the central support system 170', by exerting forces on handles 90, in a direction favorable to the player(s) on each side of the arm wrestling apparatus. The game piece 120 will then flow towards one end of the upper support rack 171' and drop down onto the first track **172*a*' of the central support rack 172'. At this point, the players will reduce the amount of forces exerted on the handles 90 to allow the game piece 120 to flow towards the drop hole 172*c*'. However, before the game piece reaches the drop hole 172*c*', the players will attempt to cause the game piece 120 to flow onto the second track 172*b*' without allowing the game piece to drop through the drop hole 172*c*'. If the game piece does drop through the drop hole 172*c*', the game piece will drop onto the lower support rack 173' for further competition of the players. However, if the players on one side of the apparatus keep the game piece on the second track 172*b*', these players can go for a "quick win" by quickly exerting additional forces in a manner which will cause the game piece to drop down to either the first or second resulting areas 136, 137 (FIG. 10**).

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An arm wrestling apparatus for competitively matching the physical strength of two or more players, comprising:

a table portion;

means for supporting the table portion, wherein the table portion is fixedly secured to the support means;

at least two means, adapted for securement to the table portion, for bracing the player's elbow;

a first arm rod rotatably secured to the support means for transferring the forces exerted by one or more players along to the other players, the first arm rod cooperatively supported by the support means and adapted for connection to an arm bar;

a second arm rod rotatably secured to the support means, for transferring the forces exerted by one or more players along to the other players, the second arm rod being substantially parallel to the first arm rod, and being cooperatively supported by the support means, and adapted for connection to an arm bar;

a plurality of arm bars fixedly connected to the respective ends of the first and second arm rods for accepting and exerting the forces exerted and accepted by the players;

a first coupler fixedly mounted to the first arm rod and adapted for connection to a connector bar for accepting and exerting forces exerted and accepted by the first arm rod;

a second coupler fixedly mounted to the second arm rod and adapted for connection to a connector bar for accepting and exerting forces exerted and accepted by the second arm rod; and, a connector bar movably linked to both the first and second arm rods through the first and second couplers, and movably mounted to the first and second couplers, the connector bar having a first notch functionally located toward one end of the connector bar for engagement with the first coupler when the first and second arm rods rotate in one direction, and the connector bar having a second notch functionally located toward the opposite end of the connector bar for engagement with the second coupler when the first and second arm rods rotate in the opposite direction.

2. The arm wrestling machine as claimed in claim 1 further comprising a locking assembly for halting and releasing the connector bar, the locking assembly comprising:

a mounting plate for supporting the locking assembly and fixedly connected to the support means;

a locking pin adapted for engagement with the connector bar;

a pin support fixedly attached to the mounting plate and having a bore for accepting and slidably supporting the locking pin;

a spring movably connected to the locking pin for biasing the locking pin in one direction;

a lever movably attached to the mounting plate at one end of the lever and movably attached to the locking pin toward the other end of the lever, for transferring force to the locking pin and for causing the pin to slide within the bore of the pin support, the locking pin halting and releasing the connector bar; and, a controller adapted to receive a signal which causes the controller to exert or remove forces on the lever.

3. The arm wrestling machine as claimed in claim 1 further comprising a coin acceptor fixedly mounted to the support means and adapted to send a signal to the locking assembly for activating the locking assembly.

4. The arm wrestling machine as claimed in claim 1 further comprising a leverage gripper fixedly mounted to the table portion for giving the player the ability to leverage against the force applied by another player.

5. The arm wrestling machine as claimed in claim 1 further comprising a set of handles pivotally mounted to the arm bars for allowing the player to change the player engagement angle with the arm bar, and for accepting and exerting forces exerted and accepted by the arm bars.

6. An arm wrestling apparatus for competitively matching the physical strength of two or more players as between the players, comprising:

a stand;

a table portion fixedly secured to and extending outwardly from the stand;

at least two elbow rests adjustably secured to the table portion and adapted for supporting an elbow of the players;

a first arm rod rotatably secured to the stand and aligned between the elbow rests for transferring the forces exerted by one or more players along to the other players, the first arm rod internally extending through the stand and adapted for connection to an arm bar at each end of the first arm rod;

a second arm rod rotatably secured to the stand and aligned between the elbow rests for transferring the forces exerted by one or more players along to the other players, the second arm rod also aligned substantially parallel to the first arm rod, internally extending through the stand, and adapted for connection to an arm bar at each end of the second arm rod;

a set of arm bars fixedly connected to the ends of the first and second arm rods for accepting and exerting the forces exerted and accepted by the players;

a connector bar movably linked to both the first and second arm rods for keeping the arm bars substantially parallel during use;

a locking assembly for halting and releasing the connector bar, the locking assembly comprising:

a mounting plate for supporting the locking assembly and fixedly connected to the stand;

a locking pin adapted for engagement with the connector bar;

a support fixedly attached to the mounting plate and having a bore for accepting and slidably supporting the locking pin;

a spring movably connected to the locking pin for biasing the locking pin in one direction;

a lever movably attached to the mounting plate at one end of the lever and movably attached to the locking pin toward the other end of the lever, for transferring force to the locking pin and for causing the pin to slide within the bore of the support, the locking pin halting and releasing the connector bar; and, a controller adapted to receive a signal which causes the controller to exert or remove forces on the lever.

7. The arm wrestling machine as claimed in claim 6 further comprising a coin acceptor fixedly mounted to the stand for activating the locking assembly.

8. The arm wrestling machine as claimed in claim 6 further comprising at least one leverage gripper fixedly mounted to the table portion for giving the player the ability to leverage against the force applied by another player.

9. The arm wrestling machine as claimed in claim 6 further comprising a set of handles pivotally mounted to the arm bars for allowing the player to change the player engagement angle with the arm bar, and for accepting and exerting forces exerted and accepted by the arm bars.

10. The arm wrestling machine as claimed in claim 6 further comprising:

a first coupler fixedly mounted to the first arm rod and adapted for connection to the connector bar for accepting and exerting forces exerted and accepted by the first arm rod; and, a second coupler fixedly mounted to the second arm rod and adapted for connection to the connector bar for accepting and exerting forces exerted and accepted by the second arm rod.

11. The arm wrestling machine as claimed in claim 10 wherein the connector bar is movably linked to both the first and second arm rods through the first and second couplers, and movably mounted to the first and second couplers, the connector bar having a first notch functionally located toward one end of the connector bar for engagement with the first coupler when the first and second arm rods rotate in one direction, and the connector bar having a second notch functionally located toward the opposite end of the connector bar for engagement with the second coupler when the first and second arm rods rotate in the opposite direction.

12. An arm wrestling apparatus for competitively matching the physical strength of two or more players as between the players, comprising:

a stand;

a table portion fixedly secured to and extending outwardly from the stand;

at least two elbow rests adjustably secured to the table portion and adapted for supporting an elbow of the players;

a first arm rod rotatably secured to the stand and aligned between the elbow rests for transferring the forces exerted by one or more players along to the other players, the first arm rod internally extending through the stand and adapted for connection to an arm bar at each end of the first arm rod;

a second arm rod rotatably secured to the stand and aligned between the elbow rests for transferring the forces exerted by one or more players along to the other players, the second arm rod also aligned substantially parallel to the first arm rod, internally extending through the stand, and adapted for connection to an arm bar at each end of the second arm rod;

a set of arm bars fixedly connected to the ends of the first and second arm rods for accepting and exerting the forces exerted and accepted by the players;

a first coupler fixedly mounted to the first arm rod and adapted for connection to a connector bar for accepting and exerting forces exerted and accepted by the first arm rod;

a second coupler fixedly mounted to the second arm rod and adapted for connection to a connector bar for accepting and exerting forces exerted and accepted by the second arm rod; and, a connector bar movably linked to both the first and second arm rods through the first and second couplers, and movably mounted to the first and second couplers, the connector bar having a first notch functionally located toward one end of the connector bar for engagement with the first coupler when the first and second arm rods rotate in one direction, and the connector bar having a second notch functionally located toward the opposite end of the connector bar for engagement with the second coupler when the first and second arm rods rotate in the opposite direction;

a locking assembly for halting and releasing the connector bar, the locking assembly comprising:

a mounting plate for supporting the locking assembly and fixedly connected to the stand;

a locking pin adapted for engagement with the connector bar;

a support fixedly attached to the mounting plate and having a bore for accepting and slidably supporting the locking pin;

a spring movably connected to the locking pin for biasing the locking pin in one direction;

a lever movably attached to the mounting plate at one end of the lever and movably attached to the locking pin toward the other end of the lever, for transferring force to the locking pin and for causing the pin to slide within the bore of the support, the locking pin halting and releasing the connector bar; and, a controller adapted to receive a signal which causes the controller to exert or remove forces on the lever.

13. The arm wrestling machine as claimed in claim 12 further comprising a coin acceptor fixedly mounted to the stand and adapted to send a signal to the locking assembly for activating the locking assembly.

14. The arm wrestling machine as claimed in claim 12 further comprising a leverage gripper fixedly mounted to the table portion for giving the player the ability to leverage against the force applied by another player.

15. The arm wrestling machine as claimed in claim 12 further comprising a set of handles pivotally mounted to the arm bars for allowing the player to change the player engagement angle with the arm bar, and for accepting and exerting forces exerted and accepted by the arm bars.

16. An arm wrestling apparatus for competitively matching the physical strength and coordination of two or more players, comprising:

a table portion;

means for supporting the table portion, wherein the table portion is fixedly secured to the support means;

means for bracing the player's elbow;

a first arm rod, rotatably secured to the support means, for transferring the forces exerted by one or more players along to the other players, the first arm rod cooperatively supported by the support means and adapted for connection to an arm bar;

a second arm rod, rotatably secured to the support means, for transferring the forces exerted by one or more players along to the other players, the second arm rod being substantially parallel to the first arm rod, the second arm rod cooperatively supported by the support means and adapted for connection to an arm bar;

a plurality of arm bars fixedly connected to the ends of the first and second arm rods for accepting and exerting the forces exerted and accepted by the players;

a first coupler fixedly mounted to the first arm rod and adapted for connection to a connector bar for accepting and exerting forces exerted and accepted by the first arm rod;

a second coupler fixedly mounted to the second arm rod and adapted for connection to a connector bar for accepting and exerting forces exerted and accepted by the second arm rod;

a connector bar movably linked to both the first and second arm rods through the first and second couplers, and cooperatively connected to the first and second couplers, a game portion including at least one game piece; a game piece action area for operative interaction with the game piece; a game piece escape portion for releasing the game piece from a first game piece wait area into the game piece action area; a first resulting area adapted to accept the game piece; and, a second resulting area adapted to accept the game piece, the first and second resulting areas determining the winning player based on the ultimate position of the game piece.

17. The game apparatus as claimed in claim 16 wherein the game piece action area includes a plurality of support racks mounted on a central support, and a plurality of pins mounted on the central support and adapted to randomly cause the game piece to generally move either toward the first support side or toward the second support side.

18. The game apparatus as claimed in claim 16 wherein the game piece escape portion includes an escape lever.

19. The game apparatus as claimed in claim 16 further including a swing rack that is rotatably connected to a central support, the swing rack being adapted to cause the game piece to randomly fall into either the first resulting area or the second resulting area.

20. The game apparatus as claimed in claim 16 wherein the first resulting area includes a first conveyor that is tilted in one direction, the first conveyor being adapted to accept the game piece when the game piece falls onto the first conveyor, and wherein the second resulting area includes a second conveyor that is tilted in one direction, the second conveyor adapted to accept the game piece when the game piece falls onto the second conveyor.

21. The game apparatus as claimed in claim 20 wherein the tilt direction of the first conveyor is in the opposite direction from the tilt direction of the second conveyor.

22. The game apparatus as claimed in claim 20 wherein the first resulting area also includes a first switch for keeping track of when the game piece falls within the first resulting area, and wherein the second resulting area also includes a second switch for keeping track of when the game piece falls within the second resulting area.

23. In an arm wrestling apparatus, for competitively matching the physical strength of two or more players, including a table portion;

means for supporting the table portion, wherein the table portion is fixedly secured to the support means;

means for bracing the player's elbow;

a first arm rod, rotatably secured to the support means, for transferring the forces exerted by one or more players along to the other players, the first arm rod cooperatively supported by the support means and adapted for connection to an arm bar;

a second arm rod, rotatably secured to the support means, for transferring the forces exerted by one or more players along to the other players, the second arm rod being substantially parallel to the first arm rod, the second arm rod cooperatively supported by the support means and adapted for connection to an arm bar;

a plurality of arm bars fixedly connected to the ends of the first and second arm rods for accepting and exerting the forces exerted and accepted by the players;

a first coupler fixedly mounted to the first arm rod and adapted for connection to a connector bar for accepting and exerting forces exerted and accepted by the first arm rod;

a second coupler fixedly mounted to the second arm rod and adapted for connection to a connector bar for accepting and exerting forces exerted and accepted by the second arm rod; and, a connector bar movably linked to both the first and second arm rods through the first and second couplers, and cooperatively connected to the first and second couplers, a game apparatus comprising:

at least one game piece;

a game piece action area including at least one support rack mounted on a central support, the central support and support rack being pivotable about a center of rotation;

a game piece escape portion for releasing a game piece from a first game piece wait area into the game piece action area, the game piece operatively interacting with the support rack;

a first resulting area adapted to accept the game piece when the game piece falls within the first resulting area; and, a second resulting area adapted to accept the game piece when the game piece falls within the second resulting area, the first and second resulting areas determining the winning player based on the ultimate position of the game piece.

24. The game apparatus as claimed in claim 23 wherein the game piece action area includes a plurality of support racks mounted on the central support, and a plurality of pins mounted on the central support and adapted to randomly cause the game piece to generally move either toward the first support side or toward the second support side.

25. The game apparatus as claimed in claim 23 wherein the game piece escape portion includes an escape lever.

26. The game apparatus as claimed in claim 23 wherein a swing rack is rotatably connected to the central support, the swing rack being adapted to cause the game piece to randomly fall into either the first resulting area or the second resulting area.

27. The game apparatus as claimed in claim 23 wherein the first resulting area includes a first conveyor that is tilted in one direction, the first conveyor adapted to accept the game piece when the game piece falls onto the first conveyor, and wherein the second resulting area includes a second conveyor that is tilted in one direction, the second conveyor adapted to accept the game piece when the game piece falls onto the second conveyor.

28. The game apparatus as claimed in claim 27 wherein the tilt direction of the first conveyor is in the opposite direction from the tilt direction of the second conveyor.

29. The game apparatus as claimed in claim 27 wherein the first resulting area also includes a first switch for keeping track of when the game piece falls within the first resulting area, and wherein the second resulting area also includes a second switch for keeping track of when the game piece falls within the second resulting area.

30. An arm wrestling apparatus for two players comprising:

a support rack having a generally planar surface horizontally and pivotally disposed about a pivot point;

a support surface;

first and second spaced handles, each of the handles being movable in a first direction and a second direction, each of the handles disposed a distance from the support surface to permit the players to grasp a respective handle and to rest an elbow on the support surface; and, means for coupling the handles to the planar surface, the coupling means transferring forces, exerted on the handles, to the planar surface, the transferred forces causing the planar surface to pivot about the pivot point.

31. The arm wrestling apparatus as claimed in claim 30 comprising a plurality of support racks having a generally planar surface, horizontally and pivotally disposed about the pivot point.

32. The arm wrestling apparatus as claimed in claim 30 further comprising:

at least one game piece;

a game piece action area, including the generally planar surface, for operative interaction with the game piece;

a game piece escape portion for releasing the game piece from a first game piece wait area into the game piece action area;

a first resulting area adapted to accept the game piece; and, a second resulting area adapted to accept the game piece, the first and second resulting areas determining the winning player based on the ultimate position of the game piece.

33. The arm wrestling apparatus as claimed in claim 32 wherein the generally planar surface is a support rack mounted on a central support, the central support pivotally disposed about the pivot point.

34. The arm wrestling apparatus as claimed in claim 33 wherein the central support includes a plurality of pins, mounted on the central support, for randomly causing the game piece to bounce off of the plurality of pins.

35. The arm wrestling apparatus as claimed in claim 33 further including a swing rack, pivotally connected to the central support, for causing the game piece to randomly fall into either the first resulting area or the second resulting area.

36. The arm wrestling apparatus as claimed in claim 32 wherein the game piece escape portion includes an escape lever.

37. The arm wrestling apparatus as claimed in claim 32 wherein the first resulting area includes a first conveyor that is tilted in one direction, the first conveyor being adapted to accept the game piece when the game piece falls onto the first conveyor, and wherein the second resulting area includes a second conveyor that is tilted in one direction, the second conveyor adapted to accept the game piece when the game piece falls onto the second conveyor.

38. The arm wrestling apparatus as claimed in claim 37 wherein the tilt direction of the first conveyor is in the opposite direction from the tilt direction of the second conveyor.

39. The arm wrestling apparatus as claimed in claim 37 wherein the first resulting area also includes a first switch for keeping track of when the game piece falls within the first resulting area, and wherein the second resulting area also includes a second switch for keeping track of when the game piece falls within the second resulting area.

40. An arm wrestling apparatus for two players comprising:

a generally planar surface pivotally disposed about a pivot point;

a support surface;

first and second spaced handles, each of the handles being moveable in a first direction and a second direction, each of the handles disposed a distance from the support surface to permit the players to grasp a respective handle and to rest an elbow on the support surface; and, means for coupling the handles to the planar surface, the coupling means transferring forces, exerted on the handles, to the planar surface, the transferred forces causing the planar surface to pivot about the pivot point, the coupling means comprising a plurality of arm bars adjustably connected to the respective handles for accepting and exerting the forces exerted and accepted by the players, at least one arm rod for connection to an arm bar, a connector bar for linking at least one arm bar to at least one other arm bar, and, a pivot bar for linking at least one of the arm bars or the connector bar to the planar surface, the pivot bar accepting and exerting the forces exerted and accepted by the arm bars or connector bar and the pivot bar transferring the forces to the planer surface, the planar surface thereby being linked to handles.

41. The arm wrestling apparatus as claimed in claim 40 further comprising:

a first arm rod; and, a second arm rod, the second arm rod being substantially parallel to the first arm rod, the first and second arm rods adapted for connection to at least one arm bar.

42. The arm wrestling apparatus as claimed in claim 41 further comprising:

a first coupler fixedly mounted to the first arm rod and adapted for connection to the connector bar for accepting and exerting forces exerted and accepted by the first arm rod; and, a second coupler fixedly mounted to the second arm rod and adapted for connection to the connector bar for accepting and exerting forces exerted and accepted by the second arm rod.

43. The arm wrestling apparatus as claimed in claim 40 wherein the generally planar surface includes at least one support rack pivotally disposed about the pivot point.

44. The arm wrestling apparatus as claimed in claim 40 wherein the generally planar surface includes a plurality of support racks pivotally disposed about the pivot point.

45. The arm wrestling apparatus as claimed in claim 40 wherein the support surface is the upper surface of a table top.

46. The arm wrestling apparatus as claimed in claim 40 wherein the support surface is the upper surface of an elbow mat.

47. The arm wrestling apparatus as claimed in claim 40 wherein the support surface is the upper surface of a plurality of elbow mats.

* * * * *

UNITED STATES PATENT AND TRADEMARK OFFICE

CERTIFICATE OF CORRECTION

PATENT NO. : 5,655,769

DATED : August 12, 1997

INVENTOR(S) : MARIO A. ARCARI

It is certified that error appears in the above-indentified patent and that said Letters Patent is hereby corrected as shown below:

Column 9, Line 34, delete "grove" and insert "groove" therefor.

Column 11, Line 21, insert "be" between the words "not" and "a".

Column 13, Line 4, delete "form" and insert "from" therefor.

Signed and Sealed this

Seventeenth Day of February, 1998

Bruce Lehman

*Attest:*

BRUCE LEHMAN

*Attesting Officer*

*Commissioner of Patents and Trademarks*